US006283589B1

(12) United States Patent
Gelbart

(10) Patent No.: US 6,283,589 B1
(45) Date of Patent: Sep. 4, 2001

(54) RESOLUTION INK JET PRINTING

(75) Inventor: Daniel Gelbart, Vancouver (CA)

(73) Assignee: Creo Srl, Holetown (BB)

( * ) Notice: Subject to any disclaimer, the term of this patent is extended or adjusted under 35 U.S.C. 154(b) by 0 days.

(21) Appl. No.: 09/071,295

(22) Filed: Apr. 29, 1998

(51) Int. Cl.[7] ..... B41J 2/01
(52) U.S. Cl. ..... 347/101; 347/100; 347/105
(58) Field of Search ..... 347/100, 101, 347/20, 105; 101/463

(56) References Cited

U.S. PATENT DOCUMENTS

| | | | | |
|---|---|---|---|---|
| 4,308,542 | * | 12/1981 | Maekawa et al. | 346/1.1 |
| 5,099,256 | * | 3/1992 | Anderson | 346/1.1 |
| 5,335,001 | * | 8/1994 | Katano | 346/76 |
| 5,372,635 | * | 12/1994 | Wasilewki et al. | 106/27 |
| 5,405,678 | * | 4/1995 | Bilodeau | 428/211 |
| 5,606,350 | * | 2/1997 | Koyama | 347/14 |
| 5,645,972 | * | 7/1997 | Jonkheere | 430/231 |
| 6,126,281 | * | 10/2000 | Shimoda et al. | 347/101 |
| 6,132,849 | * | 10/2000 | Gagnon | 428/195 |

FOREIGN PATENT DOCUMENTS

WO 96/23105 * 1/1995 (WO) ..... D21H/21/16

OTHER PUBLICATIONS

"Initial Stages of Ink Jet Drop Impaction, Spreading, and Wetting on Paper" by J.F. Oliver Tappi Journal Oct. 1984.*

* cited by examiner

*Primary Examiner*—John Barlow
*Assistant Examiner*—Manish S. Shah
(74) *Attorney, Agent, or Firm*—Oyen Wiggs Green & Mutala

(57) ABSTRACT

Improved resolution and quality of ink jet printing is achieved by treating the paper with an overcoat preventing wetting by the liquid ink. The surface tensions of the liquid droplet keeps it spherical and droplet shrinks as the liquid evaporates, leaving a small dot of concentrated pigment or dye. Fusing or overcoating is used to increase durability of the printed sheet.

18 Claims, 2 Drawing Sheets

RESOLUTION INK JET PRINTING

FIELD OF INVENTION

The invention relates to ink jet printing. The primary field is printing on paper but the invention is also useful for printing on other substrates as well as for three dimensional printing.

BACKGROUND OF THE INVENTION

Ink jet printing is a well known method of printing using a liquid ink ejected in small droplets from a small orifice. Liquid ink can be water based or based on other solvents. Liquid ink can also be generated by melting of a solid, wax-like ink. The colorant in the ink can be a dye or a pigment. While the current invention applies to all methods of ink jet printing and to all types of ink, its biggest benefit is obtained when using water based inks. The term "colorant" is used here in a generic sense and covers any component of the ink which remains after the carrier liquid evaporated. An ink component can be a colorant even if its function in the ink is not as a color. For example, when the ink is used as an etch-resist or when it is used to make a printing plate the colorant may be transparent and colorless.

All inks used in ink jet printing today wet the substrate they are deposited on. This wetting is key to adhesion and durability of the finished product. The terms "wetting" and "non-wetting" refer to the appearance of the droplet on the substrate before it dries or solidifies. FIG. 1. Shows the prior art, in which a droplet 1 is ejected from a nozzle 2 onto a substrate, normally paper, 3. After a few milliseconds of bouncing the droplet starts wetting the substrate as shown in FIG. 1-*d*. The wetting manifests itself as lowering of the contact angle θ to well below 90°. At the same time some absorption into the substrate takes place. The dry droplet, FIG. 1-*e*, has some colorant absorbed into the substrate. It is known that heating the printed substrate can increase ink adhesion and durability (see for example U.S. Pat. No. 4,308,542).

Wetting is an essential part of all prior art ink jet applications. When a material which may interfere with wetting is used to coat the paper, the material has to be treated to become highly porous or wettable by some other means. Making material highly porous promotes wetting as increasing the surface area of a material increases the surface energy, and increasing the surface energy increases wetting. Some materials which will not be wet by a liquid when applied in a continuous and smooth layer will wet well when made porous. This is the basis of U.S. Pat. No. 5,405,678 which uses a hydrophobic latex to improve paper surface but does not allow latex particles to coalesce (fuse together). The significance of leaving the surface porous is clearly stated in U.S. Pat. No. 5,405,678 (page 6, lines 13–30). This patent also recommends mixing a very hydrophilic material, such as aluminum silicate or activated clay, to promote wetting. U.S. Pat. No. 5,099,256, issued to Anderson, discloses a technique that substantially reduces wetting of a paper recording medium by ink droplets. Anderson employs an intermediate non-wettable drum surface on which ink droplets are sprayed and then dehydrated with heat before they are transferred to the final paper recording medium. The Anderson invention helps to reduce the amount of wetting on a paper recording medium and thereby reduces the dot size, dor irregularity and color to color bleeding, however it requires a more complex system with an intermediate transfer drum. Such silicone coated drums have low durability due to the softness of the silicone and the need to maintain a very fine texture on the surface. The current invention overcomes these problems. The major disadvantage of wetting is that it generates dot sizes which are too large for high quality printing, particularly in the highlight areas of pictures. The problem is more severe when wetting is followed by absorption into the paper fibers. This causes dots not only to grow but become irregular.

It is the main object of this invention to generate very small and well defined dots using all conventional ink jet printing processes and in particular when using water based inks. A second object of the invention is to generate printing plates for other methods of printing, such as lithographic printing plates and flexographic printing plates. A third object of the invention is to use the ability to create very fine dots to deposit directly chemically resistant coatings and in particular etch resists (also known by the generic name "resist") to act as masks during etching. These and further objects will become clear from the following description of the invention.

SUMMARY OF THE INVENTION

The invention greatly improves the quality and resolution possible with ink jet printing by treating the printed substrate with a coating that prevents wetting by the liquid ink. In the most common case, printing on paper with water based inks, the paper is coated with a very thin coat of a hydrophobic material. This prevents the droplets from wetting the surface, causing them to stay as small spheres due to the high surface tension of the water. As the water (and other solvents) evaporate, the size of the sphere is reduced greatly since most of the volume of the liquid ink is made up by the solvents or carrier liquid and not by the colorant. After the liquid evaporates, the small and very dense dot is fused to the substrate to increase durability (since there was no wetting the adhesion of the dried colorant to the substrate is low). In an alternative embodiment a protective overcoat is applied to the dried printed substrate. The surface tension of the droplet assures that it dries into a nearly perfect round dot, many times smaller than the dot generated by wetting. Since the dot is more concentrated (same amount of colorant in a smaller area) ink densities are high and colors are vibrant.

DESCRIPTION OF THE DRAWINGS

FIG. 4-*b* shows the actual appearance of ink jet dots, magnified about 50 times, without the use of the invention, when printed on plain paper.

DESCRIPTION OF THE PREFERRED EMBODIMENT

While the preferred embodiment will be described mainly in terms of using water based ink it should be interpreted in a generic way, covering all solvents and carrier liquids.

Figure 1:
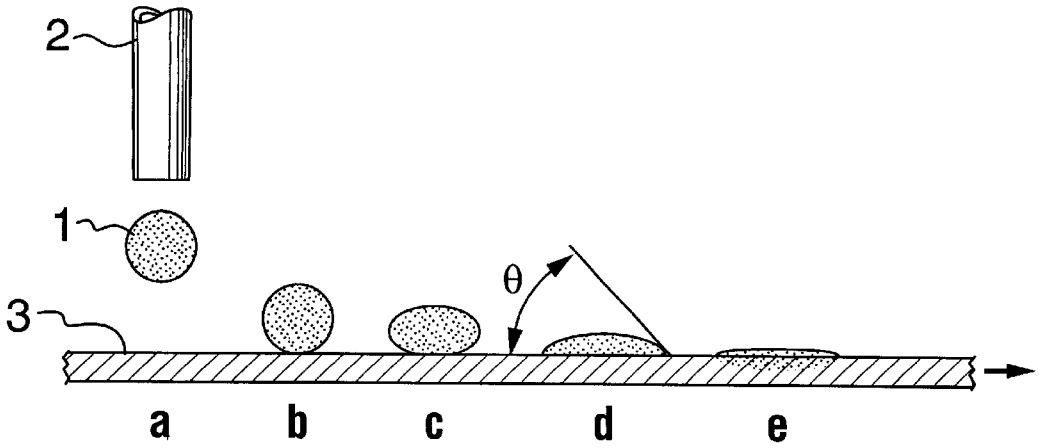
FIG. 1 PRIOR ART
FIG. 1 shows the steps ("a" to "e") in formation of a dot by ink jet printing using prior art.
Figure 2:
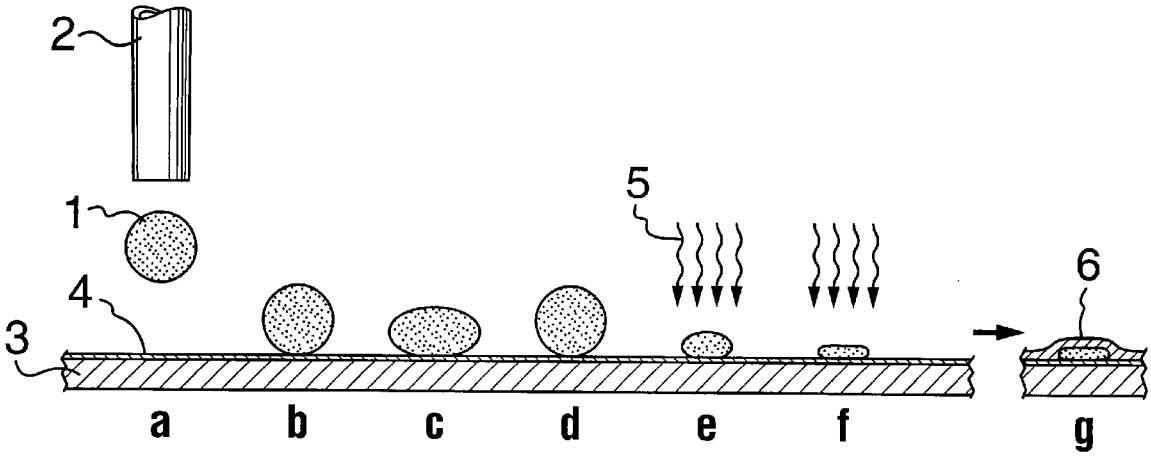
FIG. 2 shows the steps ("a" to "g") in formation of a dot by ink jet printing according to the present invention.

Referring now to FIG. 2, the substrate 3 is covered with a very thin coating 4 which is not wetted by the carrier liquid of the ink. The coating can be as thin as a single molecule (also known as "monolayer coating") as long as it is continuous. The droplet 1, containing the colorant dispersed or dissolved in a liquid, is ejected from nozzle 3 towards coating 4. Letters "a" to "f" show the steps in the formation of the dot. Since layer 4 repels the carried liquid, droplet 1 flattens on the surface upon impact as shown in FIG. 2-*c* but is pulled back to spherical form as shown in FIG. 2-*d* by surface tension. The lower the surface energy of coating 4 and the higher the surface tension of droplet 1 the more spherical droplet 1 will become after it settled and the smaller the final dot will be. This desired effect should be traded off with the fact that the lower the surface energy of layer 4 the more difficult it may be to achieve good adhesion, which is required for durability. The carrier liquid is evaporated in step "e" using heat 5 (or air drying, without heat, if time is not important) leaving a very small, dense and round dot. This dot is fused to the substrate by heating. It is desired to heat to the melting point of either coating 4 or the colorant to achieve good adhesion, or use any other kind of physical or chemical transformation to improve adhesion. Simply drying the dot produces low durability. In an alternate embodiment durability is achieved by applying an overcoat 6 as shown in FIG. 2-*g*. The overcoat can be applied as a liquid or by lamination. Clearly the liquid should not dissolve the dried colorant, thus for a water-based ink a solvent-based protective coat may be required.

Figure 3:
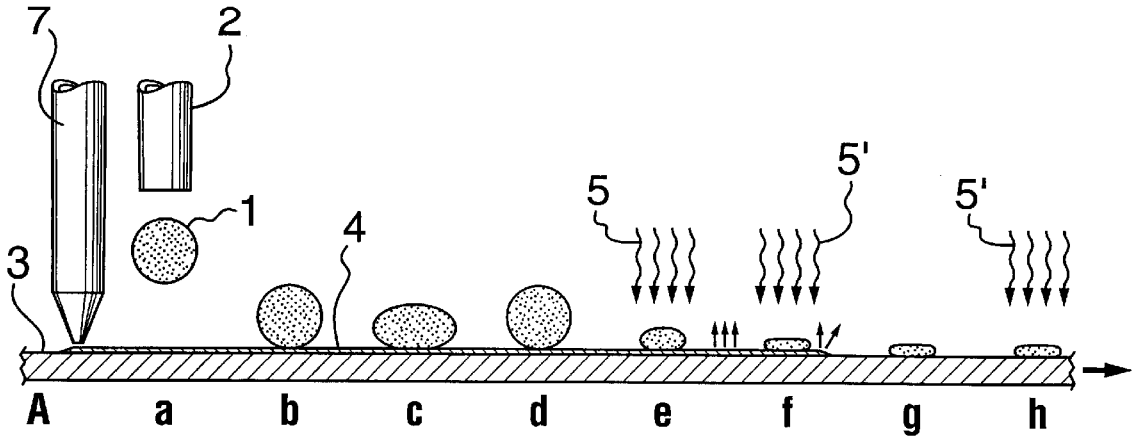
FIG. 3 shows the steps ("a" to "h") in formation of a dot by ink jet printing according to the present invention when the layer preventing wetting is only used temporarily and is not a part of the substrate.

In some application the anti-wetting coating 4 may interfere with the use of the article or may be undesirable for other reasons. In such cases the anti-wetting coating can be temporary. This is shown in FIG. 3. By the way of example, the current invention can be used for preparing lithographic printing plates by ink jetting an oleophilic polymer onto an anodized aluminum substrate. The oleophilic polymer is used to carry the lithograhic ink during printing. The anodized aluminum is used to carry water during the lithographic printing process and therefore can not be coated by a permanent hydrophobic coating which is required according to this invention when water based inks are used. In those cases a temporary hydrophobic coating can be used by applying a volatile hydrophobic agent, such as a hydrocarbon, which can easily be evaporated after the carrier liquid in the droplets has evaporated. An example of this method is shown in example 2. As the required lifetime of the hydrophobic coating is only a few minutes (it is only required during the drying of the droplets) and it can be as thin as a single molecule, the coating can be formed by directing a vapor of a hydrophobic material at the substrate. Due to absorption the vapor will form a monolayer, as long as the substrate is not porous. The same temporary application of a hydrophobic layer can also be used on paper, for example by wetting paper with volatile hydrocarbon which is evaporated after ink jet droplets are dry. Referring to FIG. 3, a nozzle 7 applies a temporary hydrophobic coat 4 which is removed by heat 5. All other steps are similar to FIG. 2.

The anti-wetting coat can be chosen from a wide range of chemicals. Hydrocarbons, mainly waxes, and polymers were found as the best choices for permanent coatings. Lower molecular weight hydrocarbons were found the best choice for temporary coatings. Acrylic polymers are a good overall choice for permanent coatings as they can be fused well with both dyes and pigments to form a durable print. Hydrocarbons give the smallest dots (lowest wetting) but are the least durable prints. Increasing the durability by overcoating with a clear acrylic varnish or lamination works well.

The invention will be illustrated in greater detail by the following specific examples:

EXAMPLE 1

Figure 4A:
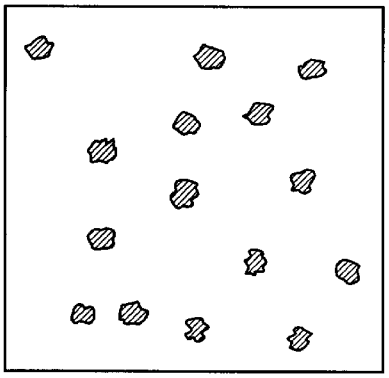
FIG. 4-*a* shows the actual appearance of ink jet dots, magnified about 50 times when printed according to the invention.
Figure 4B:
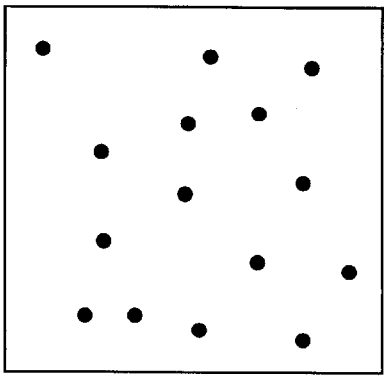

This example shows the fundamental principle of operation of the invention. Half of a plain paper sheet was coated with white paraffin wax by rubbing a candle over it lightly. The sheet was inserted in a Hewlett-Packard Desk Jet Model 310 ink jet printer. FIG. 4-*a* shows the actual appearance of the dots, magnified about 50 times, on the area coated with the hydrophobic paraffin. FIG. 4-*b* shows the dot appearance in the untreated area. As can be seen not only did the dot size reduce significantly but the ink density and dot-to-dot uniformity were improved dramatically.

EXAMPLE 2

A sheet of plain paper was coated with a wire-wound rod to a dry weight of about 10 gr/m$^2$ with a water based 40% solution of aqueous acrylic latex (BF Goodrich HYCAR #26256). After drying coating was heated to 80° C. for 10 minutes and after cooling down to 40°C. calendered with a polished roll shed roll to achieve a glossy and smooth appearance.

After printing on the coated sheet with same ink jet printer as in Example 1, sheet was heated to 80° C. for about 1 minute in order to re-melt the acrylic latex and fuse the coating. Dot sizes were significantly smaller than the same printer produced on any commercial ink jet paper.

EXAMPLE 3

The same steps as Example 2 were done except the printed sheet was not fused. Instead, the durability of print was increased by spraying with clear acrylic protective coating made by Letraset (U.K.). Same high quality small dots were printed.

EXAMPLE 4

A clear laminating sheet was used as a substitute. Since the sheet has a hydrophobic heat activated adhesive, the current invention can be practiced simply by using the adhesive coated side as a substrate. The sheet used was 4 mil (0.1 mm) thick LO-MELT made by GBC (US). After printing and air drying the ink the sheet was hot laminated to plain paper and viewed through the transparent base. A very durable print with very fine dots was produced.

EXAMPLE 5

This example shows the preparation of a lithographic printing plate using the invention. A standard anodized aluminum printing plate substrate (purchased from City Plate, N.Y., USA) was wiped with mineral spirits (a hydrocarbon mixture). Before it was dry a halftone pattern was printed on the plate with an ink jet printer using the coating of Example 2 as an ink. The mineral spirits sealed the porosity of the anodized aluminum and rendered it hydrophobic. After printing the plate was heated to 80° C. for 1 min. to drive off all hydrocarbons and fuse the ink. The fused acrylic latex acted as an oleophillic polymer and attracted lithographic printing ink. The non-inked area returned to a fully hydrophilic state.

EXAMPLE 6

A sheet of plain paper was wetted with mineral spirits and used in the ink jet printer of Example 1 before the mineral spirits dried out. The paper was rendered hydrophobic temporarily. After the ink was dry, the mineral spirits were evaporated by heating to 60° C. for 10 seconds. High quality small dots resulted.

EXAMPLE 7

This example shows the use of the invention to deposit etch resist at high resolution. The coating of Example 2 was used as an ink in an ink jet printer and was printed onto the copper cladding of a printed circuit board. Before printing the copper was wiped with a drop of motor oil, with all visible traces of oil removed by aggressive dry wiping. After printing the printed circuit board was heated to 80° C. for 10 minutes in order to fuse the acrylic latex into an etch resist, and etched conventionally. After etching the latex coating was removed using conventional resist remover (strong alkaline).

The previous examples illustrate the generic nature of the invention and its uses not just in printing but in any area where images are being formed using ink jets.

What is claimed is:

1. An ink let printing method comprising:

rendering a substrate temporarily hydrophobic by applying a hydrophobic material to the substrate;

applying droplets of a water based ink to the substrate by ink let printing; and, drying the ink.

2. The ink let printing method of claim 1 wherein rendering the substrate temporarily hydrophobic comprises exposing the substrate to a hydrocarbon and the method comprises removing the hydrocarbon after allowing the ink to dry.

3. The method of claim 2 wherein exposing the substrate to a hydrocarbon comprises wiping a thin layer of the hydrocarbon onto the substrate.

4. The method of claim 2 wherein exposing the substrate to a hydrocarbon comprises directing a hydrocarbon vapor at the substrate.

5. The method of claim 2 comprising removing the hydrocarbon from the substrate after the ink has substantially dried.

6. The method of claim 1 comprising adhering the ink to the substrate after the ink has substantially dried.

7. The method of claim 6 wherein adhering the ink to the substrate comprises heating the ink sufficiently to fuse the dried ink with the substrate.

8. The method of claim 6 wherein adhering the ink to the substrate comprises applying a protective coating over the dried ink.

9. The method of claim 6 wherein adhering the ink to the substrate comprises applying a lamination over the dried ink.

10. The method of claim 1 wherein the substrate comprises paper.

11. The method of claim 1 wherein the substrate comprises a circuit board and the ink comprises a resist.

12. The method of claim 1 wherein the substrate comprises an anodized aluminum lithographic printing plate.

13. The method of claim 1 wherein the substrate comprises a normally hydrophilic lithographic printing plate and the ink comprises a material which, when dry, is hydrophobic, the method comprising applying the ink only in areas of the lithographic printing plate which are desired to be hydrophobic and, after allowing the ink to dry, returning the substrate to its normal hydrophilic state.

14. The method of claim 2 wherein removing the hydrophobic material comprises heating the substrate.

15. The method of claim 2 wherein the hydrocarbon comprises a wax.

16. The method of claim 2 wherein the hydrocarbon comprises mineral spirits.

17. The method of claim 2 wherein the hydrocarbon is a volatile hydrocarbon and removing the hydrophobic material comprises allowing substantially all of the volatile hydrocarbon to evaporate.

18. The method of claim 1 comprising removing the hydrophobic material from the substrate after allowing the ink to dry.

* * * * *